United States Patent [19]

Crespy

[11] Patent Number: 4,522,584

[45] Date of Patent: Jun. 11, 1985

[54] LIGHTER COMBINED WITH INSTRUMENT

[76] Inventor: Serge Crespy, P.O. Box 383, Collingwood, Ontario, Canada, L9Y 3Z7

[21] Appl. No.: 509,606

[22] Filed: Jun. 30, 1983

Related U.S. Application Data

[62] Division of Ser. No. 372,694, Apr. 28, 1982, abandoned.

[51] Int. Cl.[3] ..... F23Q 2/32

[52] U.S. Cl. ..... 431/253; D27/38; D21/64; 30/459

[58] Field of Search ..... 431/253, 202, 129–141; 206/85, 86; 131/178, 185, 234; 46/175 R, 179; D21/64; D27/36, 38; D10/119

[56] References Cited

U.S. PATENT DOCUMENTS

| | | | |
|---|---|---|---|
| D. 192,098 | 1/1962 | Bautsch | D21/64 X |
| 256,738 | 4/1882 | Boman et al. | 7/160 |
| 670,141 | 3/1901 | Shepard | 431/202 |
| 1,776,283 | 9/1930 | Harasimiak . | |
| 2,308,225 | 1/1943 | Edenburg | 431/253 |
| 2,828,855 | 4/1958 | Mosch | 206/38 |
| 2,921,495 | 1/1980 | Ichikawa | 431/253 X |
| 3,150,507 | 9/1964 | Smith | 431/253 |
| 4,247,283 | 1/1981 | Vidas | 431/253 |
| 4,304,548 | 12/1981 | Ruhaut et al. | 431/253 X |

FOREIGN PATENT DOCUMENTS

| | | | |
|---|---|---|---|
| 138287 | 7/1934 | Austria . | |
| 4645 | 4/1879 | Fed. Rep. of Germany | 131/178 |
| 13777 | 6/1898 | United Kingdom | 131/178 |
| 21680 | 11/1900 | United Kingdom | 131/178 |

*Primary Examiner*—Margaret A. Focarino

*Attorney, Agent, or Firm*—Kerkam, Stowell, Kondracki & Clarke

[57] ABSTRACT

An article includes a pocket-sized housing which combines a cigarette lighter with an instrument having a transforming cavity. The instrument may be a pencil sharpener or a whistle.

2 Claims, 2 Drawing Figures

LIGHTER COMBINED WITH INSTRUMENT

This is a divisional of application Ser. No. 372,694, filed Apr. 28, 1982, now abandoned.

BACKGROUND OF THE INVENTION

This invention relates to cigarette lighters. More particularly, this invention relates to cigarette lighters combined with other useful instruments, such as pencil sharpeners or whistles.

The prior art includes various structures for combining a lighter with a pen. The following patents are illustrative:

| U.S. Pat. No. | Inventor | Issue Date |
|---|---|---|
| 2,308,225 | Edenburg | Jan. 12, 1943 |
| 2,828,855 | Mosch | April 1, 1958 |
| 3,150,507 | Smith | Sept. 29, 1964 |

The Edenburg patent shows a lighter combined with a pen or pencil.

The Mosch patent shows a lighter combined with a pen, pencil, nail file, knife, screwdriver, can opener, or flashlight. The lighter may be combined with more than one of those implements. The implements which are combined with the lighter are interchangeably connected to a portion of the lighter body.

The Smith patent discloses the lighter combined with a pen, the lighter being specially constructed so as to avoid the use of a lid.

Other patents, such as the following, have shown cigarette lighters in combination with other devices:

| U.S. Pat. No. | Inventor | Issue Date |
|---|---|---|
| 2,921,495 | Ichikawa | Jan. 19, 1960 |
| 4,304,548 | Ruhaut et al | Dec. 8, 1981 |

The Ichikawa patent discloses a lighter having a built-in music box device.

The Ruhaut et al patent discloses a cigarette lighter combined with a key to facilitate the opening of frozen locks.

Previous patents further include the following:

| U.S. Pat. No. | Inventor | Issue Date |
|---|---|---|
| 256,738 | Boman et al | April 18, 1882 |
| 1,776,283 | Harasimiak | Sept. 23, 1930 |
| 4,247,283 | Vidas | Jan. 27, 1981 |

The Boman et al patent discloses a combined pencil point protector, twine cutter, and whistle.

The Harasimiak patent discloses a combined key and pencil sharpener.

The Vidas patent discloses a flaming trumpet or musical instrument whereby the musician may generate audience excitement by causing the trumpet to flame.

Although the above and other devices known heretofore have been generally useful, none of these devices has combined a cigarette lighter with a pencil sharpener. Similarly, the prior art lacks the advantageous combination of a cigarette lighter with a whistle. Since both a pencil sharpener and a whistle require an internal cavity, these devices are often thought of as being too bulky to carry on one's person on a regular basis.

SUMMARY OF THE INVENTION

Accordingly, it is a primary object of the present invention to provide a new and improved cigarette lighter.

A further object of the present invention is to provide a cigarette lighter in combination with a pencil sharpener.

A further object of the present invention is to provide a cigarette lighter in combination with a whistle.

These and other objects of the present invention are realized by an article comprising a pocket-sized housing, a cigarette lighter housed in the housing, and an instrument housed in the housing. The instrument has an input hole for receiving an input, walls defining a transforming cavity for transforming the input received by way of the input hole, and an output hole for allowing an output to pass out of the transforming cavity. The instrument may be a sharpening tool and, more specifically, a pencil sharpener where the input hole is shaped and sized to allow a pencil end to be inserted in the transforming cavity and the output hole allows pencil shavings to leave the transforming cavity, and further including a pencil sharpening blade adjacent the output hole for sharpening a pencil end by rotation of the pencil end while it is disposed within the transforming cavity. Alternately, the instrument may be a breath operated sound producing instrument, the input hole adapted to receive a breath input, the transforming cavity transforming a breath input into a sound output, and the output hole outputs the sound output. More specifically, the sound producing instrument is a whistle. The housing may be made of plastic and form at least part of the walls of the transforming cavity.

BRIEF DESCRIPTION OF THE DRAWINGS

The above and other features of the present invention will be more apparent when viewed in conjunction with the accompanying drawings wherein.

DETAILED DESCRIPTION OF THE PREFERRED EMBODIMENTS

Figure 1:
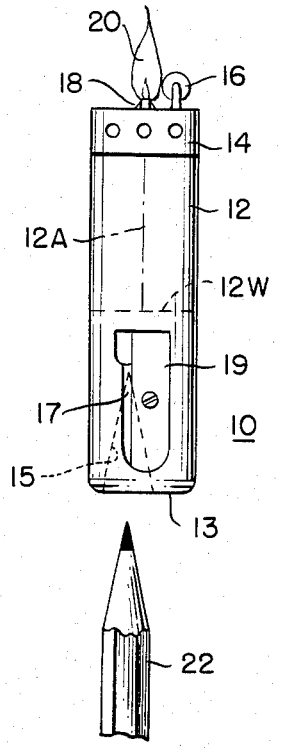
FIG. 1 shows a combined lighter and pencil sharpener according to the present invention.

Turning now to FIG. 1, a preferred embodiment of the present invention will be discussed. Specifically, FIG. 1 shows an article 10 combining a cigarette lighter and a pencil sharpener. The article 10 includes a housing 12, a cigarette lighter built in to the upper part of the housing 12, and a pencil sharpener built in to the lower part of the housing 12. The upper and lower parts of housing 12 are separated by wall 12W.

At the upper part of housing 12 there is a metallic portion 14 which may serve to protect the preferably plastic housing 12 from the lighter flame 20. a spark wheel 16 or similar actuator may be used to turn on and off flame 20 out of a nozzle 18. If desired, the flame 20 may be disposed on a wick (not shown) in a fashion well known in the art. The inner workings of the cigarette lighter may be made in a number of conventional ways and need not be discussed in detail. As an alternative to wall 12W the lighter fluid may be disposed around the cone 15, just inside the conical wall.

The lower part of the housing 12 includes a pencil sharpener having an input hole 13 for insertion of a pencil 22 into a transforming cavity 15. Upon rotation of the pencil 22 in the cavity 15, the pencil will be sharpened by the sharpening blade 19 attached to the housing 12. Shavings from the pencil will exit the transforming cavity 15 by way of an output hole 17. As shown, the walls of the housing 12 may extend sufficiently inward to define the transforming or sharpening cavity 15.

Figure 2:
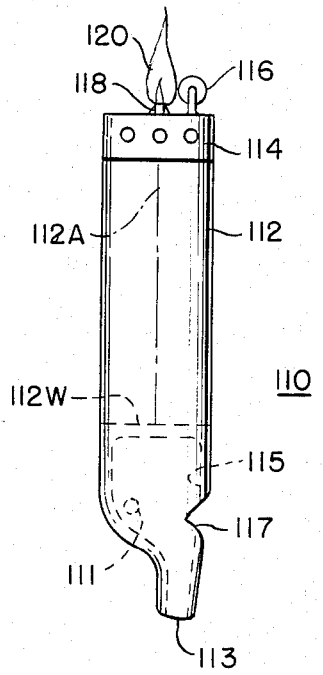
FIG. 2 shows a combined lighter and whistle according to the present invention.

Turning now to FIG. 2, an alternate embodiment of the present invention wherein a cigarette lighter is combined with a whistle will be discussed. In particular, the parts of the FIG. 2 embodiment are numbered in the 100 series with the last two digits corresponding to the same part as with the FIG. 1 embodiment. For example, the article 110 has a housing 112 in a fashion generally corresponding to the article 10 and housing 12 of the FIG. 1 embodiment. Likewise, metallic portion 114, spark wheel or similar actuating device 116, nozzle 118 and flame 120 are constructed in a fasion identical to the FIG. 1 embodiment. Indeed, the upper part of housing 112 and the lighter parts above wall 112W may be identical to the parts above wall 12W of FIG. 1.

The FIG. 2 embodiment includes a whistle below the wall 112W as shown. The whistle includes an input hole 113, a resonant or transforming cavity 115, and an output hole 117. Additionally, a ball 111 may be used as is common in whistles.

The operation of the whistle in the FIG. 2 embodiment is relatively straightforward. A breath input is used as by having someone blow into the input hole 115. The cavity defined by walls 115, which are formed from the housing input into a resonant frequency sound vibration output at output hole 117.

The housings 12 and 112 may be composed of plastic. In that case, the housings 12 or 112 may be molded at the same time as the molding of the transforming cavity defined by walls 15 or 115. Other materials could of course be used.

The fuel reservoir of the lighter disposed within the upper portion of housing 12 or 112 could be refillable as by unscrewing portion 14. Any of numerous other known techniques for refilling the lighter may be used. Alternately, the lighter may be of the disposable kind in which case the article 10 or 110 could be simply be kept for use as either a pencil sharpener or a whistle.

The housing 12 or 112 may be cylindrical with its axis 12A or 112A extending lengthwise as shown.

As used herein an "instrument" shall refer to a tool, implement, or the like. A "transforming cavity" refers to a cavity which changes an input into a different form as, for example, an input of a dull pencil end may be transformed into a sharp pencil end.

Although various details of construction have been disclosed herein, these are for illustrative purposes only. Various modifications and adaptations will be readily apparent to those of ordinary skill in the art. Accordingly, the scope of the present invention should be determined by reference to the claims appended hereto.

What is claimed is:

1. An article comprising:

(a) a pocket-sized plastic housing, having upper and lower parts (b) a cigarette lighter included in the upper part of said housing and operable by lighter fluid from a reservoir in said cigarette lighter, and (c) an instrument included in said lower part of said housing, said instrument separated from said cigarette lighter by a wall and having an input hole for receiving an input, walls defining a transforming cavity for transforming said input received by way of said input hole, and output hole for allowing an output to pass out said transforming cavity, and wherein said instrument is a breath operated whistle, said input hole is adapted to receive a breath input, said transforming cavity transforms a breath input into a sound output, and said output hole outputs the sound output, and wherein said housing forms said walls.

2. The article of claim 1 wherein said cigarette lighter comprises a spark wheel and a lighter fluid nozzle.

* * * * *